United States Patent [19]

Otsuki et al.

[11] 4,430,606

[45] Feb. 7, 1984

[54] SHEET FEEDING APPARATUS

[75] Inventors: Haruaki Otsuki; Hiromu Hirai, both of Ibaraki; Masataka Kawauchi, Ishioka, all of Japan

[73] Assignee: Hitachi, Ltd.

[21] Appl. No.: 297,404

[22] Filed: Aug. 28, 1981

[30] Foreign Application Priority Data

Sep. 8, 1980 [JP] Japan ..... 55-123566

[51] Int. Cl.[3] ..... G05B 19/28

[52] U.S. Cl. ..... 318/601; 318/616

[58] Field of Search ..... 318/561, 615, 616, 617, 318/618, 601, 632

[56] References Cited

U.S. PATENT DOCUMENTS

| | | | |
|---|---|---|---|
| 3,622,766 | 11/1971 | David | 318/616 X |
| 4,015,183 | 3/1977 | Miyakita | 318/601 |
| 4,224,559 | 9/1980 | Miller | 318/601 |
| 4,276,502 | 6/1981 | Elliott | 318/615 X |

*Primary Examiner*—B. Dobeck

*Attorney, Agent, or Firm*—Antonelli, Terry & Wands

[57] ABSTRACT

In a sheet feeding apparatus for transmitting the rotation of the motor shaft of a motor to a sheet feeding shaft for feeding a sheet by an elastic transmission mechanism, a speed state amount of either or both of the motor shaft and sheet shaft is compared to a position deviation signal at the input side of the motor and the resulting deviation signal therebetween is applied to the motor as a motor control signal to control it, thereby improving the dynamic characteristics of the sheet feeding.

10 Claims, 14 Drawing Figures

SHEET FEEDING APPARATUS

BACKGROUND OF THE INVENTION

This invention relates to sheet feeding apparatus using an elastic body at its power transmission portion, and particularly to a sheet feeding servo apparatus requiring precise control of the position and speed of a sheet as does an apparatus for reading information from the sheet and writing it thereon while the sheet is being fed.

In the conventional sheet feeding apparatus, the shaft of the actuator for generating power is often not directly coupled to the sheet feeding shaft for feeding the sheet but is coupled thereto through a power transmission mechanism of which the type varies, for convenience of speed change and mounting. An example thereof is disclosed in Japanese Patent Application Laid-Open No. 78212/1979. This power transmission mechanism includes gear, belt, chain and so on. Use of belt will result in great influence on the characteristics of the sheet feeding apparatus because power is transmitted through the elastic belt. When a slender shaft is used for transmission of power, it acts as an elastic body to reduce its torsional rigidity. As a result, the dynamic characteristics of the sheet feeding apparatus is greatly influenced similarly as in the above description. That is, in the sheet feeding apparatus of this kind, the actuator for generating power is provided with an encoder for detecting the position signal thereof, and the position signal detected by the encoder is fed back to the input of the actuator by a position servo system thus to control the position. However, for rapid acceleration, the sheet cannot be controlled precisely.

SUMMARY OF THE INVENTION

It is an object of the invention to provide a sheet feeding apparatus capable of precisely controlling the position of a sheet even although the sheet is fed at a rapid acceleration.

It is another object of the invention to provide a sheet feeding apparatus capable of suppressing the vibration caused by the elastic body and the inertia of each shaft in the power transmission mechanism, thereby to obtain good sheet feeding characteristics.

The feature of this invention is that a sheet feeding apparatus in which the rotation of the motor shaft of a motor is transmitted to the sheet feeding shaft for feeding the sheet by an elastic transmission mechanism, is provided with a feed-back circuit for indicating the speed of either or both of the motor shaft and the sheet feeding shaft, back to the input, or position deviation signal side of the motor, so that this feed-back circuit controls the movement of the motor shaft to improve the dynamic characteristics of the sheet feeding shaft.

Other features and effects of the invention will be apparent in the following description with reference to the accompanying drawings.

DESCRIPTION OF THE PREFERRED EMBODIMENTS

Figure 1:
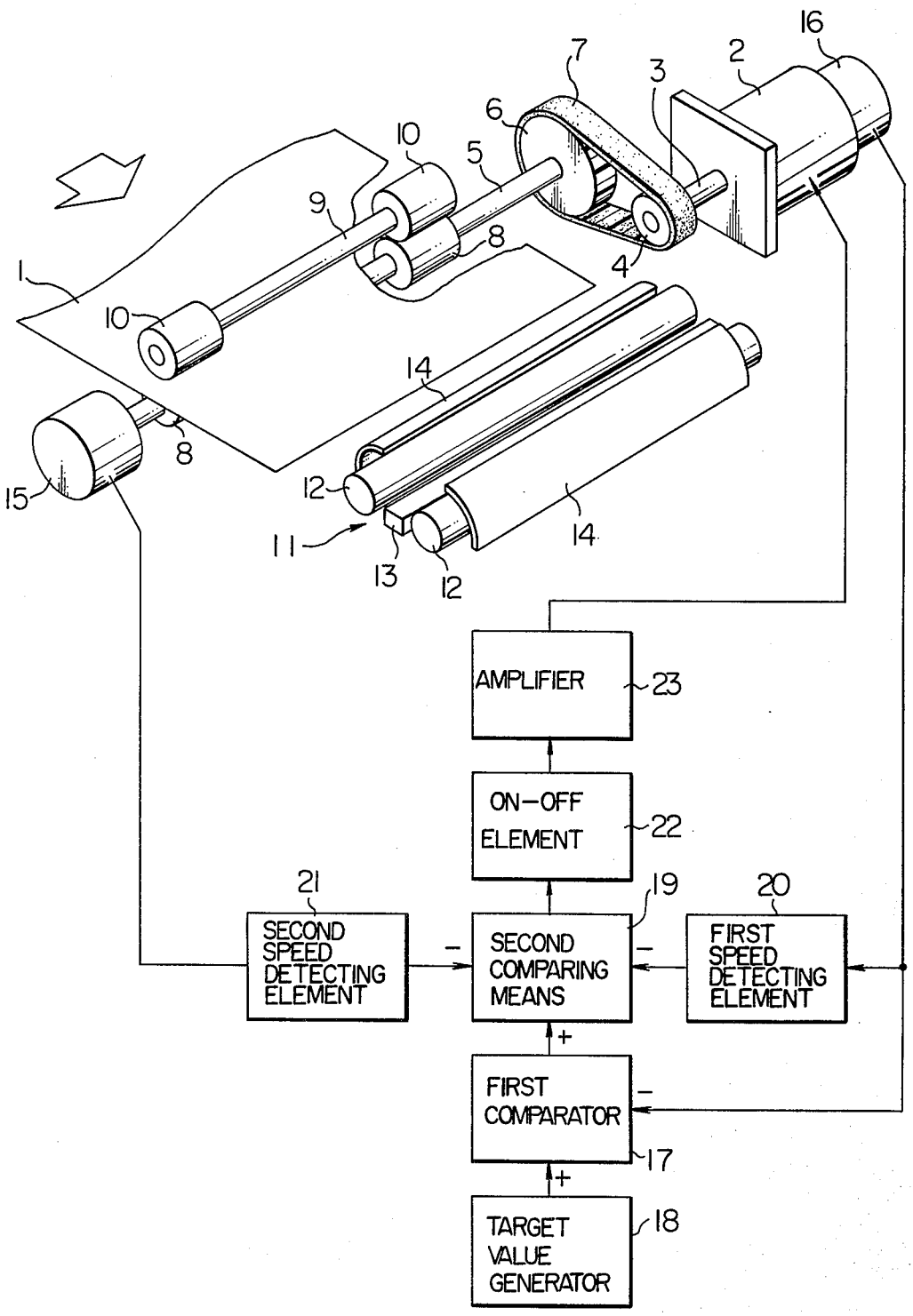
FIG. 1 is an embodiment of the sheet feeding apparatus of the invention.

FIG. 1 shows the arrangement of one embodiment of the sheet feeding apparatus of the invention. Referring to FIG. 1, there are shown a sheet 1 and a motor 2. A drive pulley 4 is securely mounted to a shaft 3 of the motor 2. A sheet feeding shaft 5 is provided in parallel to the motor shaft 3, and a driven pulley 6 is fastened to the motor-side end of the sheet feeding shaft 5. Between the driven pulley 6 and the drive pulley 4 is extended a timing belt 7. A pair of lower rollers 8 are secured on the sheet feeding shaft 5. An upper roller shaft 9 is rotatably provided above the sheet feeding shaft 5 and a pair of upper rollers 10 are secured on the upper roller shaft 9. On this upper roller shaft 9 is exerted a downward force so that the sheet 1 is fed or carried passing between the upper roller 10 of the upper roller shaft 9 and the lower roller 8 as indicated by an arrow. The sheet 1 then passes by a read portion 11, where it is illuminated by fluorescent lamps 12 from the upward direction and the information on the sheet 1 is read by a read sensor 13. Above the fluorescent lamps 12 are provided reflecting covers 14. The sheet feeding shaft 5 is provided at its end opposite to the motor 2, with an encoder 15 for detecting the angle that the sheet feeding shaft 5 is rotated. The motor 2 is also provided with an encoder 16 for detecting the angle the motor shaft 3 is rotated. The encoder 16 generates a signal indicative of the rotation angle of the motor shaft 3 is rotated, and this signal is negatively fed back to a first comparator 17. The first comparator 17 compares a target value signal from a target value generator 18 with the rotational angle signal concerning the motor shaft 3 to produce the position deviation signal. A second comparing means 19 compares the position deviation signal from the first comparator 17 with a speed signal from a first speed detecting element 20 and a speed signal from a second speed detecting element 21 to produce the deviation signal. The first speed detecting element 20 converts the rotational angle signal associated with the motor shaft 3 from the encoder 16 to a speed signal. The second speed detecting element 21 converts the rotational angle associated with the sheet shaft 5 from the encoder 15 to a speed signal. The second comparing means 19 feeds the deviation signal to an ON-OFF element 22, which makes the operation-amount voltage zero if the deviation signal is negative or zero, and supplies the deviation signal via an amplifier 23 to the motor 2 if not so.

Figure 2:
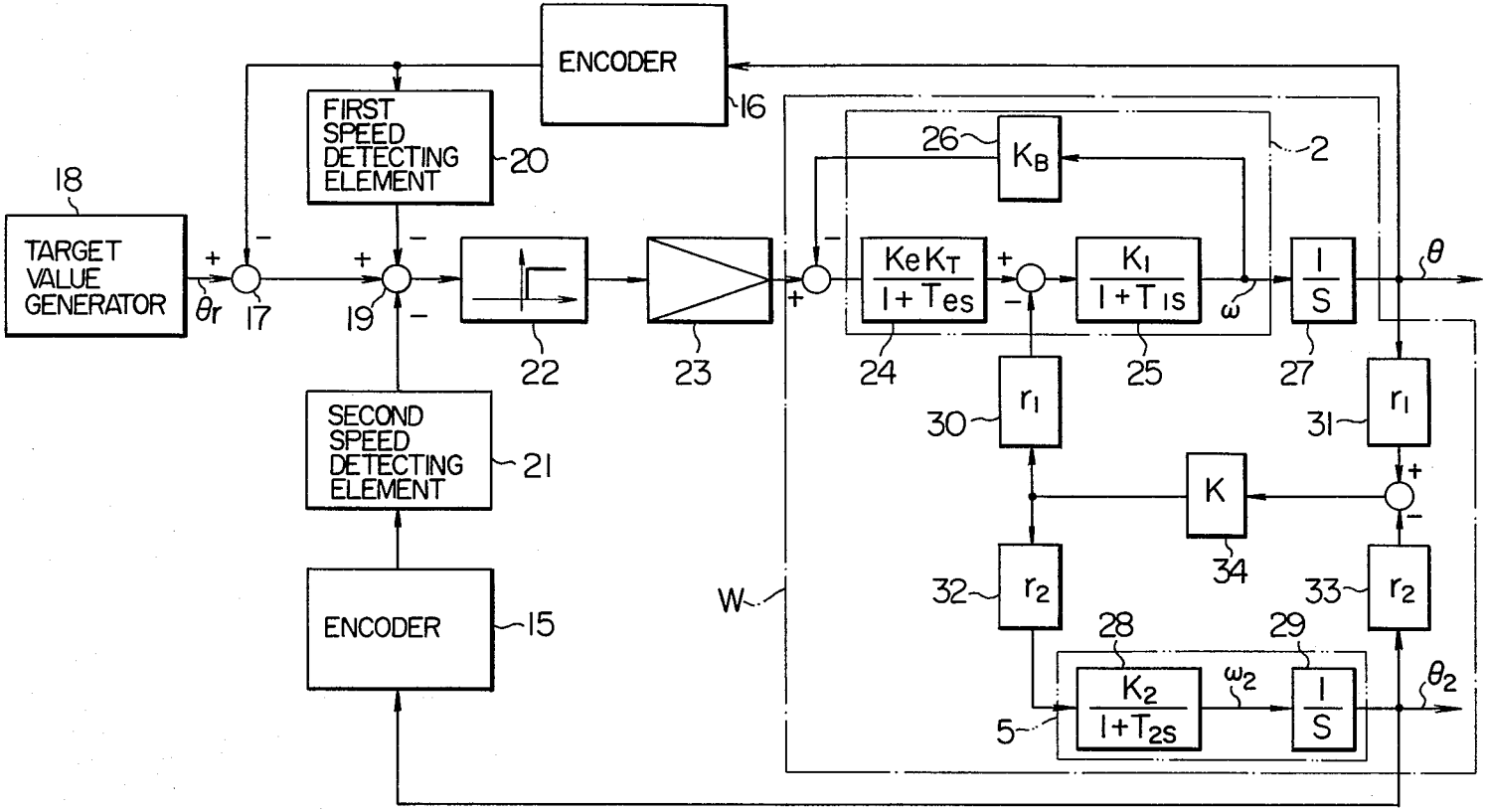
FIG. 2 is a block diagram of the control arrangement in the embodiment of the sheet feeding apparatus of the invention as shown in FIG. 1.

FIG. 2 is a block diagram of the control circuit of the sheet feeding apparatus of the invention in FIG. 1. In FIG. 2, like elements corresponding to those of FIG. 1 are identified by the same reference numerals. A portion W surrounded by a one-dot chain line in FIG. 2 corresponds to the motor 2 and the load and also to the mechanism portion shown in FIG. 1. The output of the ON-OFF element 22 in FIG. 2 is amplified by the amplifier 23 and supplied to the motor 2 and the load as indicated by the broken line. In the motor 2 and the load, each block of an electrical primary delay element 24 of the motor 2, a mechanical primary delay element 25 of the motor shaft 3 and an induced voltage constant element 26 of the motor 2 exhibit the dynamic characteristics of the motor 2. The angular velocity $\omega$ of the motor shaft 3 is converted to the rotational angle $\theta$ of the motor shaft 3 by an integration element 27. A mechanical primary delay element 28 and an integration element 29 for the sheet feeding shaft 5 exhibit the dynamic characteristics of the sheet feeding shaft 5. Radius constant elements 30 and 31 of the drive pulley 4, radius constant elements 32 and 33 of the driven pulley 6 and an elasticity constant element 34 of the timing belt 7 show the dynamic characteristics of the belt transmission mechanism interposed between the motor shaft 3 and the sheet feeding shaft 5. The rotational angle $\theta$ of the motor 3 is detected by the encoder 16 and fed back to the input. Thus, a positional deviation is obtained by subtracting the rotational angle $\theta$ from the target rotational angle $\theta_r$. On the other hand, the speed detecting elements 20 and 21 detect the speeds of the shafts 3 and 5 on the basis of the rotational angles from the encoders 16 and 15, respectively. The outputs of the speed detecting elements 20 and 21 are subtracted from the positional deviation, and the difference is applied to the ON-OFF element 22.

The speed detecting elements 20 and 21 will be described with reference to FIGS. 3 to 6.

Figure 3:
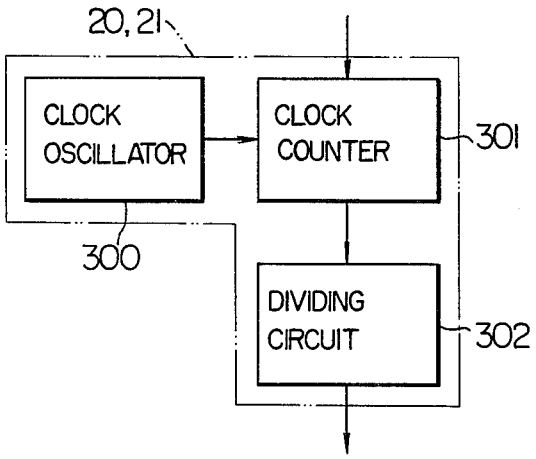
FIG. 3 is a block diagram of one example of the speed detecting element used in the invention.

FIG. 3 shows a first example of the speed detecting element 20, 21. Referring to FIG. 3, a clock oscillator 300 generates a clock pulse as a time reference for measurement. A clock counter 301 holds the count of clock pulses in a register every time the output pulse occurs from the encoder 16, 15, and the counter restarts counting after being reset. A dividing circuit 302 divides the unit amount of quantization in the encoder 16, 15, by the value held in the register in the clock counter 301 to determine the speed which is then outputted.

Figure 4:
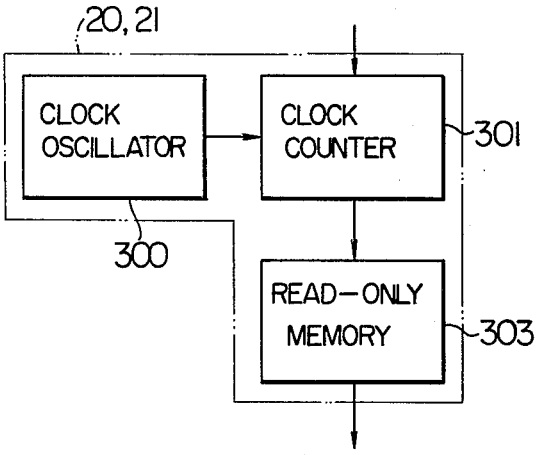
FIG. 4 is a block diagram of another example of the speed detecting element used in the invention.

FIG. 4 shows a second example of the speed detecting element 20, 21. This second example differs from the first example of FIG. 3 in that the dividing circuit 302 in FIG. 3 is replaced by a read-only memory 303. The read-only memory 303 has function forms of fraction functions stored and has the contents of the clock counter 301 as address input. At the respective addresses of the read-only memory 303 are stored the results of division corresponding to the count of the counter 301, or valves of fraction function, and thus the read-only memory 303 produces at the data output the valves of the fraction function, or speeds.

Figure 5:
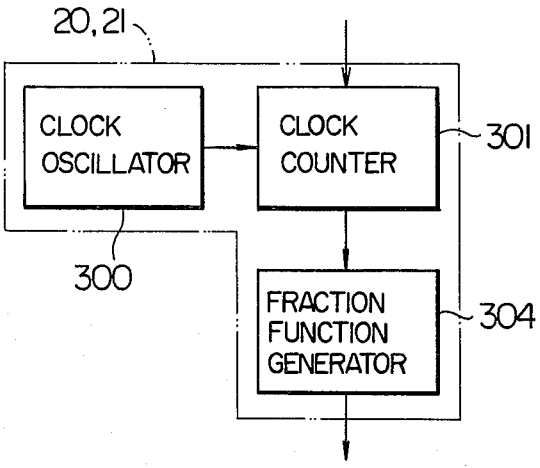
FIG. 5 is a block diagram of still another example of the speed detecting element used in the invention.

FIG. 5 shows a third example of the speed detecting element 20, 21. The third example of FIG. 5 differs from the first example in that the dividing circuit 302 in FIG. 3 is replaced by an approximate fraction function generating circuit 304. The approximate fraction function generating circuit 304 makes the fraction functions approximated to polygonal lines, calculates approximate speeds by adding and subtracting circuits associated with the individual segments of the polygonal line and outputs the approximate speeds.

Figure 6:
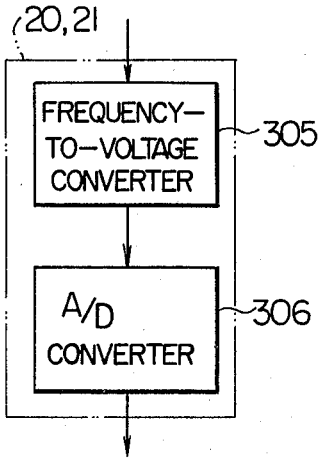
FIG. 6 is a block diagram of further example of the speed detecting element used in the invention.

FIG. 6 shows a fourth example of the speed detecting element 20, 21. In this example, a frequency-to-voltage converter (abbreviated as FV converter) 305 for converting the frequency of the pulse signal from the encoder 16, 15 to a voltage is provided to produce a voltage proportional to speed by the conversion of the output signal from the encoder 16, 15, and this voltage is quantized by an A/D converter 306.

Figure 7:
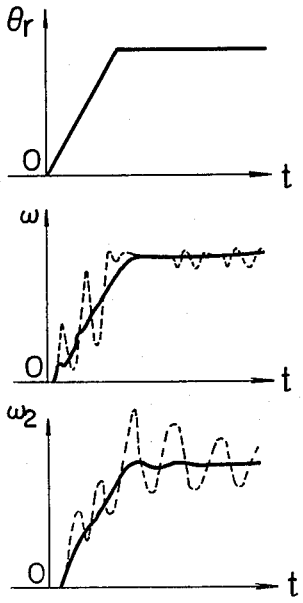
FIG. 7 is a graph of the characteristics of the conventional sheet feeding apparatus and the sheet feeding apparatus according to the invention.

FIG. 7 is graphs of the results for confirming the effect of the invention. In FIG. 7, $\theta_r$ represents the target speed determined in accordance with the change of the positional target value with time, $\omega$ the angular speed of the motor shaft 3, and $\omega_2$ the angular speed of the sheet feeding shaft 5. The broken curves in the graphs of FIG. 7 show the change of each variable upon starting of the conventional sheet feeding apparatus having a servo system for feeding only the position of motor shaft back to the input. The solid curves thereof show the change of each variable upon starting of the sheet feeding apparatus according to the invention which has two speed-feedback systems for the angular velocities of the motor shaft 3 and the sheet feeding shaft 5 in the position servo system of motor 2. From the comparison of the curves it will be obvious that in the invention, the dynamic characteristics of the sheet feeding apparatus is improved and the angular speed $\omega_2$ of the sheet feeding shaft 5 becomes coincident to the target angular velocity $\theta_r$ with lapse of time. On the other hand, it was ascertained by experiment that the movement of the sheet 1 substantially coincides with that of the sheet feeding shaft 5. Therefore, the dynamic characteristics of the sheet 1 under movement can be improved as the dynamic characteristics of the sheet feeding shaft 5 becomes improved.

Figure 9:
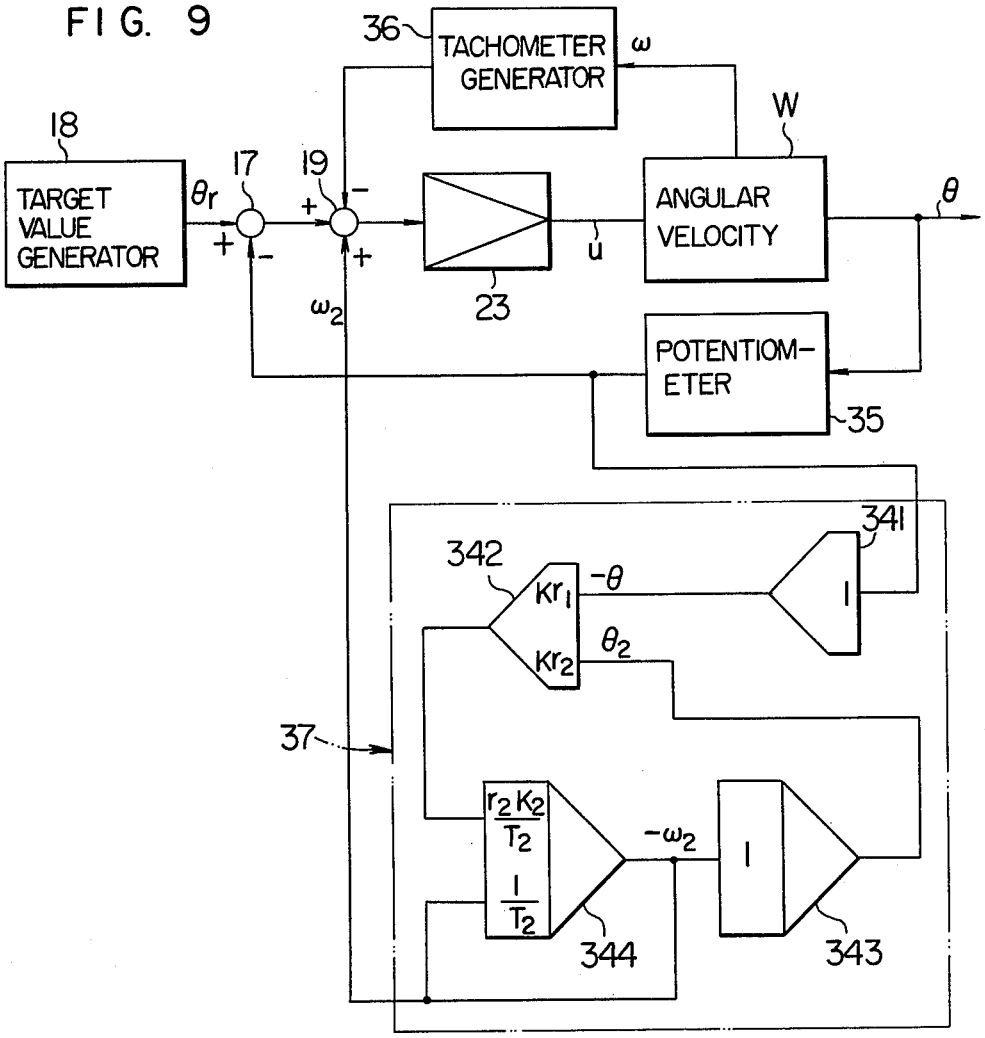
FIG. 9 is a block diagram of the control arrangement in the sheet feeding apparatus of the invention as shown in FIG. 8.
Figure 8:
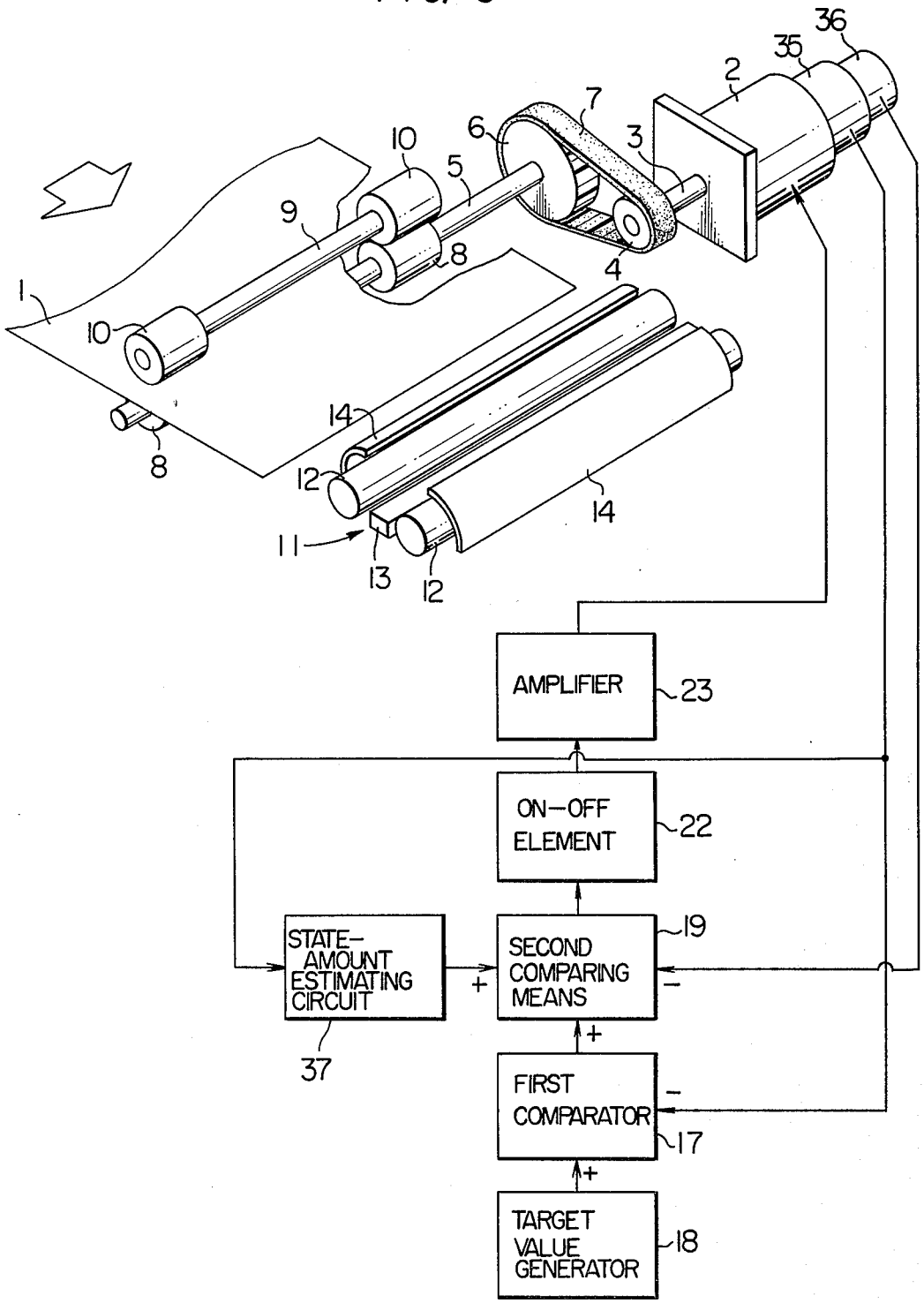
FIG. 8 shows another embodiment of the sheet feeding apparatus of the invention.

FIG. 8 shows another embodiment of the sheet feeding apparatus of the invention, and FIG. 9 is a block diagram of the control circuit therefor. In FIGS. 8 and 9, like elements corresponding to those of FIGS. 1 and 2 are identified by like reference numerals. The ON-OFF element 22 in FIG. 8 is omitted in FIG. 9. The sheet feeding apparatus of FIG. 8 is capable of bidirectional movement within a certain range of rotational angles. In FIG. 8, the target rotational angle $\theta_r$ given by the target value generator 18 minus the rotational angle $\theta$ of the motor shaft 3 which is detected by a potentiometer 35 results in a positional deviation. From the positional deviation is subtracted the speeds of the motor shaft 3 and sheet feeding shaft 5, and the resulting difference is amplified by the amplifier 23 to be voltage u as an operation amount at its output. This voltage u is applied to the motor 2 and the load to be controlled which is represented by reference character W. The angular velocity $\omega$ of the motor shaft 3 is detected by a tachometer generator 36 which is coupled to the motor shaft 3, while the angular velocity $\omega_2$ of the sheet feeding shaft 5 is computed from the output of the potentiometer 35 in a state-amount estimating circuit 37. The state-amount estimating circuit 37 simulates the dynamic characteristics of the radius constant elements 30 and 31 of the drive pulley 4, the elastic constant element 34 of the timing belt 7, the radius constant elements 32 and 33 of the driven pulley 6, and the mechanical primary delay element 25 and integration element 29 of the motor shaft 3 in FIG. 2 with the aid of the analog computing circuit. In the state-amount estimating circuit 37, an adding coefficient element 341 inverts the sign of the rotational angle $\theta$ of the motor shaft 3 detected by the potentiometer 35 into $-\theta$. An adding coefficient element 342 is supplied at one input with the output of the adding coefficient element 341, or $-\theta$ and at the other input with the estimated amount $\theta_2$ of the rotational angle of the sheet feeding shaft 5 which is produced from an integrator 343. The output of the adding coefficient element 342 is connected to one input of an adding integrator 344. To the other input of the adding integrator 344 is fed back the output of the adding integrator 344. The output of the adding integrator 344 is the estimated value $-\omega_2$ that is different in the sign from the angular velocity $\omega_2$ of the sheet feeding shaft 5. This estimated value $-\omega_2$ is applied to the integrator 343 and also fed in speed back to the input as the output of the state-amount estimating circuit 37. In this embodiment, if the parameter value of each element is obtained, it is unnecessary to provide a detector on the sheet feeding shaft 5. The adding coefficient amplifying circuits 341 and 342 may be inverting operational amplifiers as disclosed in FIG. 13.98(a), page 13-126 of the Electronics Designers' Handbook, Second Edition, McGraw-Hill Book Company. The integrator 343 and adding integrator 344 may be operational amplifiers as disclosed in FIG. 13.99(a), page 13-128 of the above-referenced publication.

Figure 10:
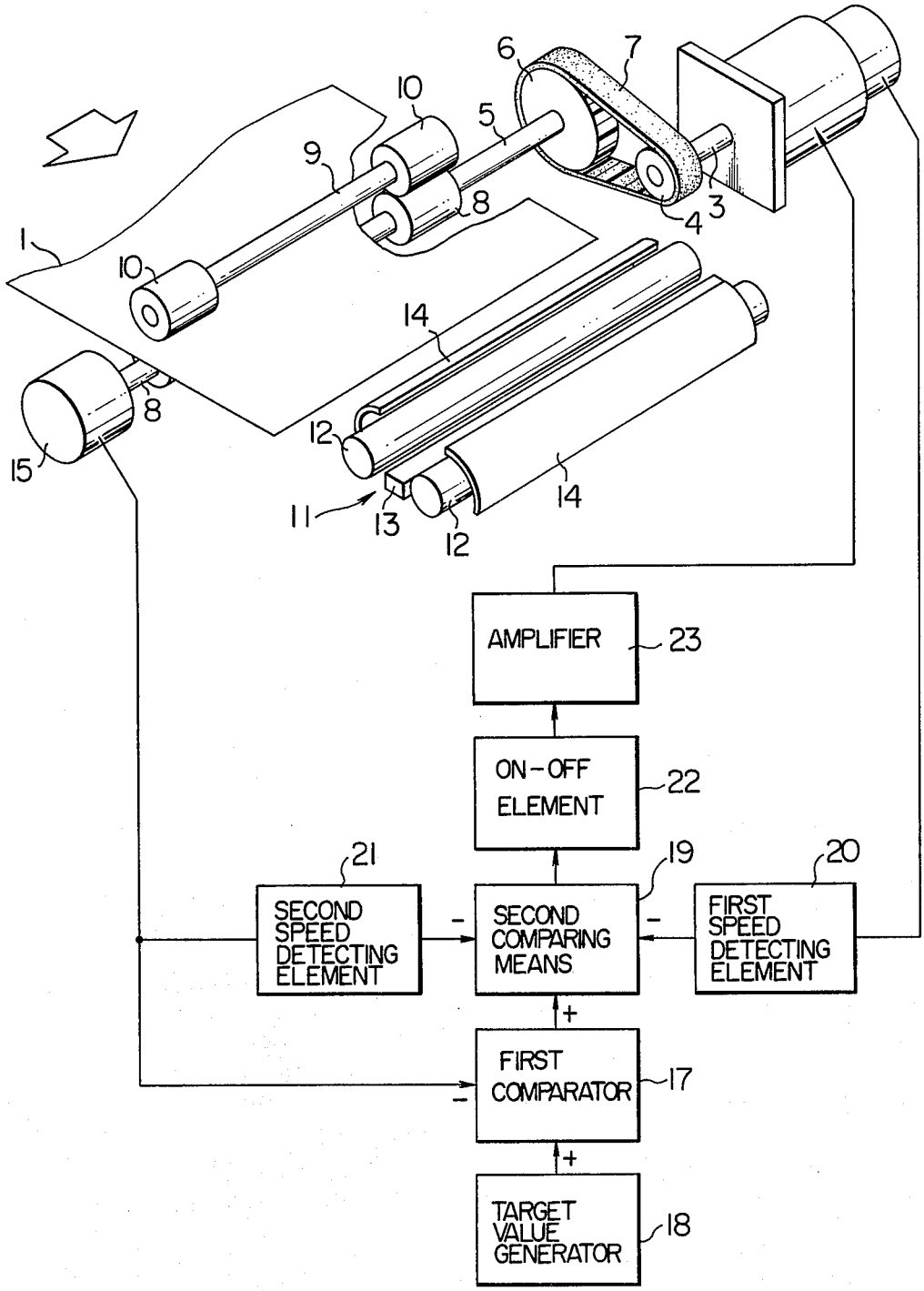
FIG. 10 shows still another embodiment of the sheet feeding apparatus of the invention.

FIG. 10 is still another embodiment of the sheet feeding apparatus of the invention. In FIG. 10, like elements corresponding to those of FIG. 1 are identified by the same reference numerals. Similarly as in FIG. 1, to the second comparing means 19 is negatively fed back the speed signal of the motor shaft 3 from the first speed detecting element 20 and the speed signal of the sheet shaft 5 from the second speed detecting element 21. The position signal of the sheet feeding shaft 5 from the encoder 15 is negatively fed back to the first comparator 17 as a signal for the position servo control. With the above arrangement, the dynamic characteristics of the sheet 1 under movement are improved similarly as in the previous embodiments.

Figure 11:
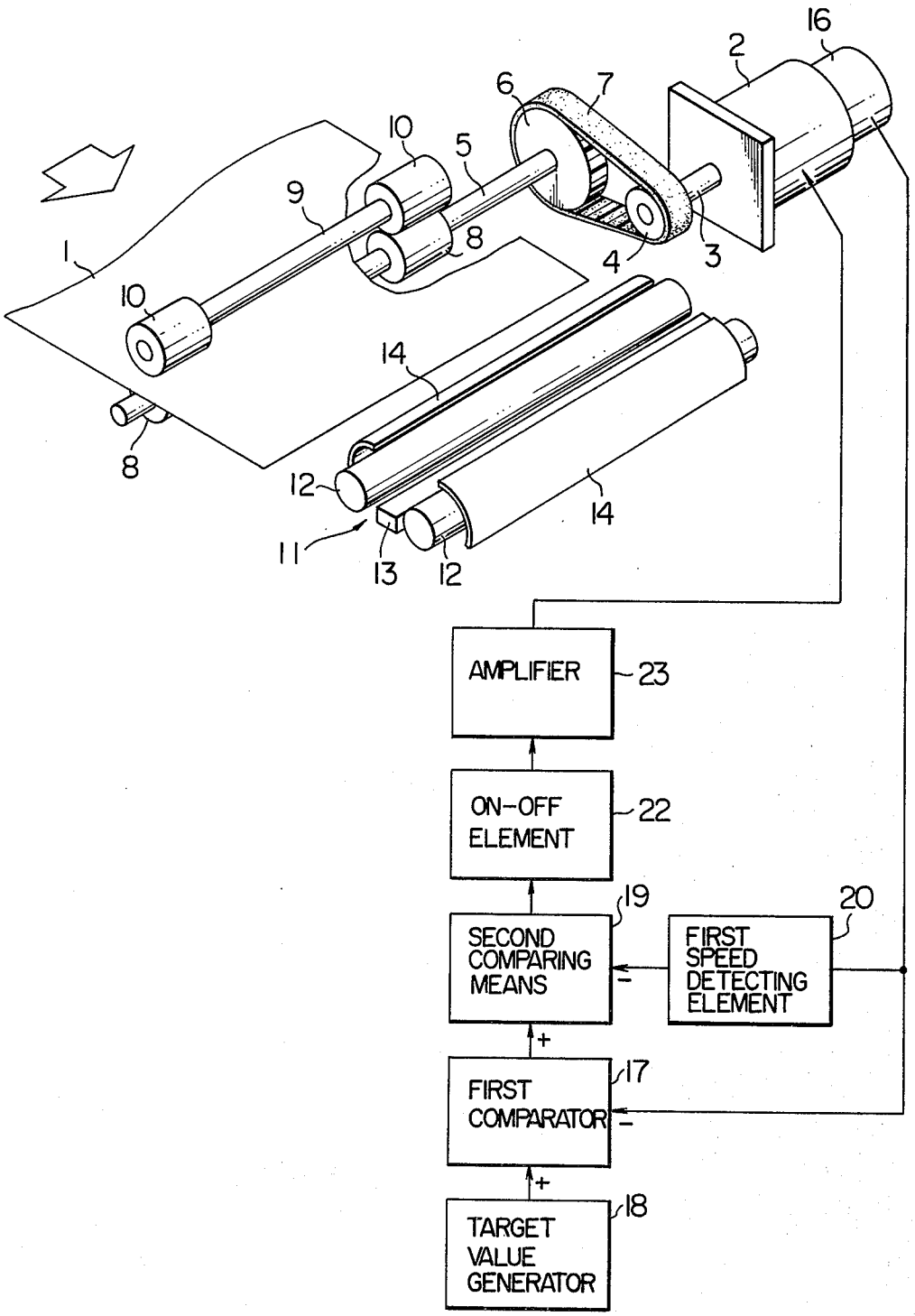
FIG. 11 shows a further embodiment of the sheet feeding apparatus of the invention.
Figure 13:
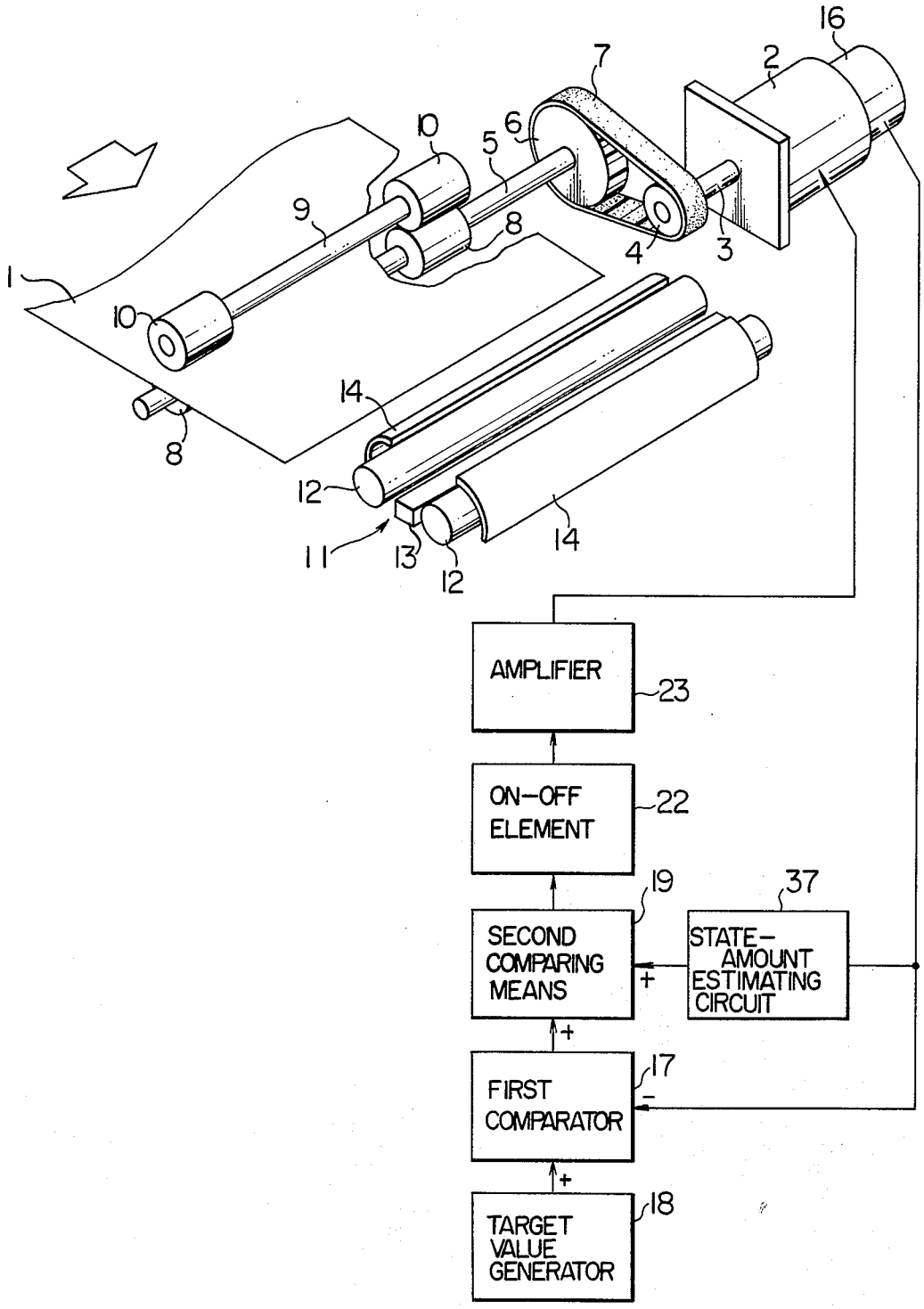
FIG. 13 shows a still further embodiment of the sheet feeding apparatus of the invention.
Figure 14:
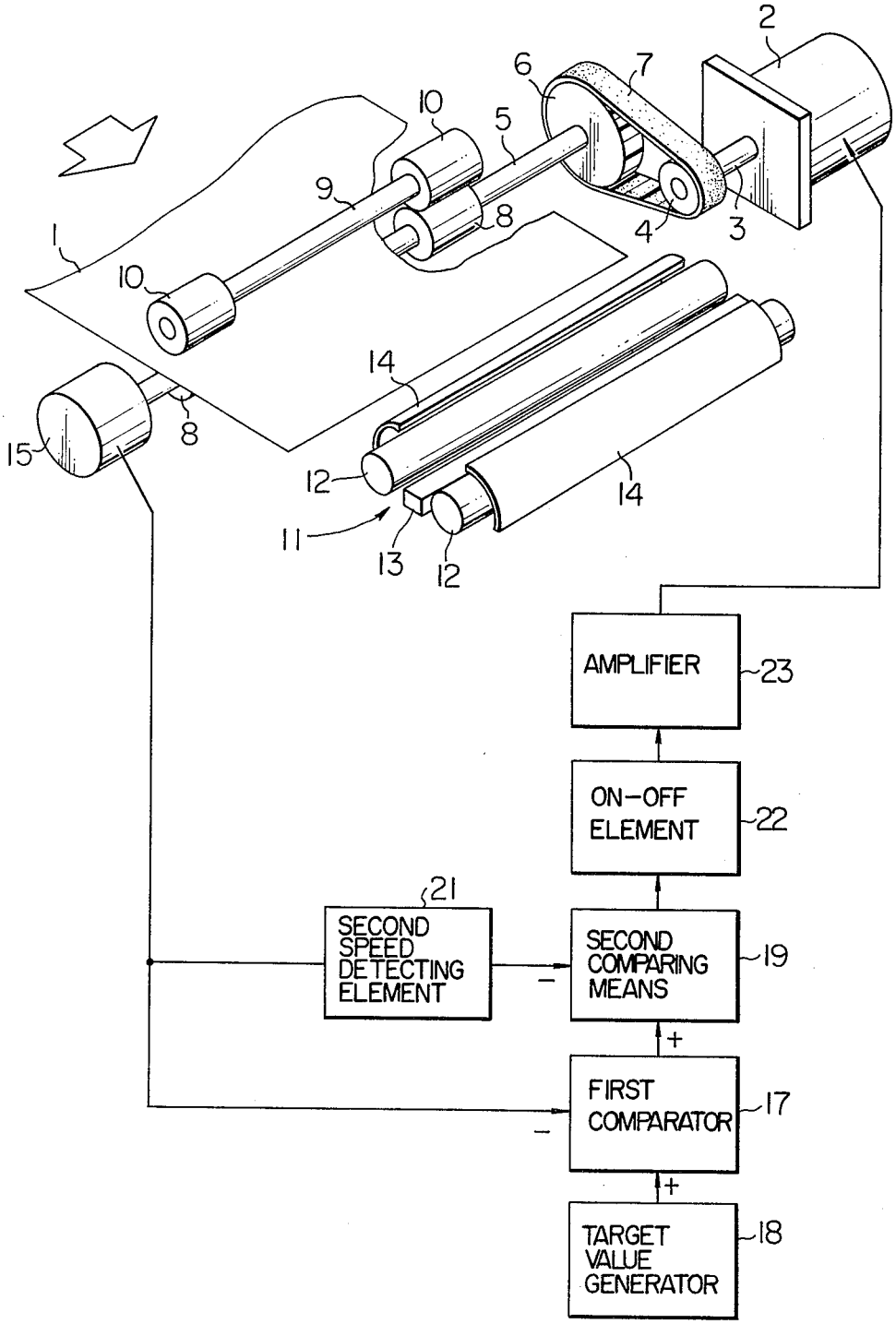
FIG. 14 shows a further embodiment of the sheet feeding apparatus of the invention.

FIGS. 11, 13 and 14 show other embodiments of the sheet feeding apparatus of the invention. In FIGS. 11, 13 and 14, like elements corresponding to those of FIGS. 1 and 8 are identified by the same reference numerals, and will not be described in detail. In these embodiments, the speed signal of either motor shaft 3 or sheet feeding shaft 5 is negatively fed back to the second comparing means 19.

The sheet feeding apparatus of the invention as shown in FIG. 11 will now be described. To the first comparator 17 is negatively fed back the position signal of the motor shaft 3 from the encoder 16 as a signal for the position servo control, and to the second comparing means 19 is negatively fed back the speed signal of the motor shaft 3 from the first sped detecting element 20. Such arrangement of this embodiment can improve the dynamic characteristics of the sheet 1 under movement similarly as in the previously described embodiments.

Figure 12:
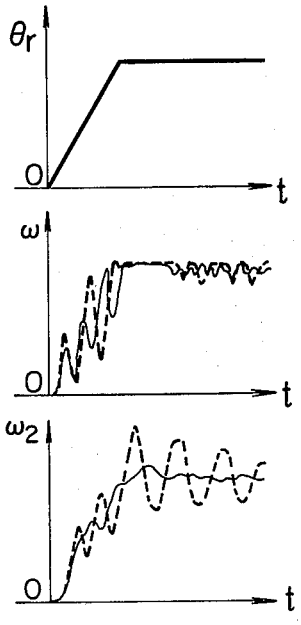
FIG. 12 is a graph of the characteristics of the conventional sheet feeding apparatus and the sheet feeding apparatus of the invention as shown in FIG. 11.

The measured results of the dynamic characteristics as shown in FIG. 12, are slightly poorer than in the embodiment in which the speed signals of the motor shaft 3 and sheet shaft 5 are fed back to the second comparing means 19, but clearly improved as compared with those of the conventional apparatus.

In the sheet feeding apparatus of the invention as shown in FIG. 13, the position signal of the motor shaft 3 is negatively fed back to the first comparator 17 from the encoder 16 as a signal for position servo control, and the speed signal of the sheet shaft 5 which the state amount estimating circuit 37 produces in response to the position signal of motor shaft 3 from the encoder 16, is fed back to the second comparing means 19. This arrangement can achieve the same effect as in the embodiment of FIG. 11.

In the sheet feeding apparatus of the invention as shown in FIG. 14, to the first comparator 17 is fed back the position signal of the sheet feeding shaft 5 from the encoder 15 as a signal for position servo control, and to the second comparing means 19 is fed back the speed signal of the sheet feeding shaft 5 from the second speed detecting element 21. This arrangement is able to achieve the same effect as in the embodiment of FIG. 11.

According to this invention, as described above, it is possible to suppress the vibration caused by the elastic body and the inertia associated with each shaft in the power transmission mechanism, and thereby to achieve good sheet feeding characteristics. As a result, the apparatus of this invention, when used in the apparatus for reading information from a sheet and writing information onto the sheet, or other similar apparatus, can improve the reliability of reading and the quality of information upon writing.

We claim:

1. A sheet feeding apparatus for transmitting the rotation of a motor shaft of a motor to a sheet feeding shaft for feeding a sheet by an elastic transmission mechanism, comprising:

a target value generator for generating a target position signal;

a position detector for detecting the position of at least either of said sheet shaft or said motor shaft as a signal;

first comparing means for comparing said two signals to produce a signal indicative of a positional deviation;

a speed detecting element for generating a signal indicative of a speed of at least either of said sheet shaft or said motor shaft;

second comparing means for comparing said positional deviation signal and a signal indicative of the speed to produce a deviation signal therebetween; and control means for controlling said motor in accordance with the deviation signal from said second comparing means.

2. A sheet feeding apparatus according to claim 1, wherein said first comparing means compares the position signal of the motor shaft and the target value signal to produce a position deviation signal therebetween.

3. A sheet feeding apparatus according to claim 2, wherein said second comparing means compares the positional deviation signal from the first comparing means and the speed signal from the speed detecting element to produce a deviation signal therebetween, said speed detecting element generating the speed signal in accordance with the position signal of the motor shaft.

4. A sheet feeding apparatus according to claim 2, wherein said second comparing means compares the positional deviation signal from the first comparing means and the speed signal from the speed detecting element to produce a deviation signal therebetween, said speed detecting element being a state-amount estimating circuit for calculating and generating the speed signal of the sheet shaft in accordance with the position signal of the motor shaft.

5. A sheet feeding apparatus according to claim 1, wherein said first comparing means compares the position signal of the sheet shaft and the target value signal to produce a positional deviation signal therebetween.

6. A sheet feeding apparatus according to claim 5, wherein said second comparing means compares the positional deviation signal from the first comparing means and the speed signal from the speed detecting element to produce the deviation signal and the speed detecting element is a state amount estimating circuit for computing and generating the speed signal of the motor shaft in accordance with the position signal of the sheet shaft.

7. A sheet feeding apparatus for transmitting the rotation of a motor shaft of a motor to a sheet feeding shaft for feeding a sheet by an elastic transmission mechanism comprising:

a target value generator for generating a target position signal;

a position detector for detecting the positions of the sheet shaft and motor shaft;

first comparing means for comparing the position signal of at least either of the motor shaft or the sheet shaft and the target value signal to generate a signal indicative of a position deviation therebetween;

a speed detecting element for generating signals indicative of the speeds of the sheet shaft and motor shaft;

second comparing means for comparing said position deviation signal and the speed signals of the sheet shaft and motor shaft to produce a comparison value signal; and control means for controlling said motor in accordance with the deviation signal from said second comparing means.

8. A sheet feeding apparatus according to claim 7, wherein said first comparing means compares the position signal of motor shaft and the target value signal to generate a position deviation signal therebetween.

9. A sheet feeding apparatus according to claim 7, wherein said first comparing means compares the position signal of the sheet shaft and the target value to produce a position deviation signal therebetween.

10. A sheet feeding apparatus for transmitting the rotation of a motor shaft of a motor to a sheet feeding shaft for feeding a sheet by an elastic transmission mechanism comprising:

a target value generator for generating a target position signal;

a position detector for detecting the position of the motor shaft as a signal;

a speed detector for detecting the speed of the motor shaft as a signal;

a state amount estimating circuit for computing and generating the speed signal of the sheet shaft in accordance with the position signal of the motor shaft;

first comparing means for comparing the position signal of the motor shaft and the target value signal to produce a signal indicative of a positional deviation;

second comparing means for comparing said position deviation signal and the speed signals of the sheet shaft and the motor shaft to generate a deviation signal therebetween; and control means for controlling said motor in accordance with the deviation signal from the second comparing means.

* * * * *

UNITED STATES PATENT AND TRADEMARK OFFICE

CERTIFICATE OF CORRECTION

PATENT NO. : 4,430,606

DATED : February 7, 1984

INVENTOR(S) : Haruaki OTSUKI, Hiromu HIRAI and Masataka KAWAUCHI

It is certified that error appears in the above–identified patent and that said Letters Patent are hereby corrected as shown below:

On the Title page, at [73] Assignee, after "Hitachi, Ltd." add --and Hitachi Koki Co., Ltd.--.

Signed and Sealed this

*Twenty-fourth* Day of *July 1984*

[SEAL]

*Attest:*

GERALD J. MOSSINGHOFF

*Attesting Officer*

*Commissioner of Patents and Trademarks*